US005603784A

United States Patent [19]

Bay

[11] Patent Number: 5,603,784

[45] Date of Patent: Feb. 18, 1997

[54] METHOD FOR PRODUCING A ROTATABLE GRAY IRON BRAKE COMPONENT

[75] Inventor: Stephen M. Bay, Fremont, Ind.

[73] Assignee: Dayton Walther Corporation, Dayton, Ohio

[21] Appl. No.: 407,732

[22] Filed: Mar. 20, 1995

[51] Int. Cl.[6] ..... C21D 5/02

[52] U.S. Cl. ..... 148/612

[58] Field of Search ..... 148/612, 618

[56] References Cited

U.S. PATENT DOCUMENTS

| | | | |
|---|---|---|---|
| 2,906,651 | 9/1959 | Saives | 148/618 |
| 3,901,739 | 8/1975 | Mandoki . | |
| 4,484,953 | 11/1984 | Kovacs et al. . | |
| 4,596,606 | 6/1986 | Kovacs et al. . | |
| 4,666,533 | 5/1987 | Kovacs et al. . | |
| 4,867,804 | 9/1989 | Kobayashi . | |
| 4,891,076 | 1/1990 | Kovacs . | |
| 4,961,791 | 10/1990 | Metzler et al. | 148/612 |
| 5,064,478 | 11/1991 | Kovacs et al. . | |
| 5,246,510 | 9/1993 | Kovacs et al. . | |
| 5,253,698 | 10/1993 | Keough et al. . | |

FOREIGN PATENT DOCUMENTS

| | | |
|---|---|---|
| 190018 | 8/1986 | Japan . |
| 1-62412 | 3/1989 | Japan . |
| 257138 | 11/1991 | Japan . |

OTHER PUBLICATIONS

"Iron Casting Handbook" Copyright 1981, pp. 121–151, 203–295, and 533–597.

*Primary Examiner*—Deborah Yee
*Attorney, Agent, or Firm*—MacMillan, Sobanski & Todd

[57] ABSTRACT

A method for producing a brake component involves providing a cast gray iron rotatable brake component where the gray iron has a carbon content between 3.4% and 4.0%. The brake component is subjected to an austempering heat treatment process. Then it is subjected to a re-tempering process to provide a microstructure which consists of spheroidized pearlite carbon in a matrix of bainitic and austenitic ferrite.

20 Claims, 2 Drawing Sheets

METHOD FOR PRODUCING A ROTATABLE GRAY IRON BRAKE COMPONENT

BACKGROUND OF THE INVENTION

This invention relates in general to vehicle brake systems, especially brake systems for heavy duty trucks, and in particular to an improved method for casting a rotatable brake component from gray iron.

Virtually all wheeled vehicles are provided with a brake system for selectively inhibiting the rotation of the wheels and, therefore, slowing the movement of the vehicle. To accomplish this, a typical vehicle brake system includes a friction brake assembly which is provided at one or more of the vehicle wheels. Upon actuation bv a driver of the vehicle through manual movement of a brake pedal and an associated pneumatic or hydraulic actuating system, the friction brake assemblies are effective to inhibit the rotation of the vehicle wheel.

Such vehicle friction brake assemblies are generally classified into two types, namely, drum brake assemblies and disc brake assemblies. In a drum brake assembly. a hollow cylindrical drum is secured to the wheel of the vehicle for rotation therewith, while a brake shoe assembly is secured to the nonrotatable component of the vehicle. The brake shoe assembly includes a pair of arcuate friction shoes which are operatively connected to a pneumatically or hydraulically actuated piston. The friction shoes are disposed within the hollow drum adjacent to the inner cylindrical surface thereof. The friction shoes are normally spaced apart from the inner cylindrical surface of the drum. When the driver of the vehicle manually moves the brake pedal, the piston is actuated to move the friction shoes apart from one another into frictional engagement with the inner cylindrical surface of the drum. As a result, rotation of the drum and its associated wheel are inhibited.

In a disc brake assembly, a rotor or disc is secured to the wheel of the vehicle for rotation therewith. while a brake caliper assembly is secured to a non-rotatable component of the vehicle, such as the vehicle frame. The brake caliper assembly includes a pair of friction pads which are operatively connected to a hydraulically or pneumatically actuated piston. The friction pads are disposed on opposite sides of the rotor and are normally spaced apart therefrom. When the driver of the vehicle manually moves the brake pedal, the piston is actuated to move the friction pads toward one another into frictional engagement with the rotor. As a result, rotation of the rotor and its associated wheel are inhibited.

in the past, drums and rotors of the type described above have been formed from gray iron using a conventional "as-cast" method. The "as-cast" method simply involved casting molten gray iron into the desired shape of the drum or rotor and subsequently cooling, followed only by cleaning and machining when necessary. Thus, the "as-cast" method has been found to be desirable because it is a relatively simple and inexpensive method to perform. Also, gray iron has been found to be an acceptable matenal to use in the "as-cast" method because it provides the resultant drums and rotors with sufficient mechanical and physical properties for use in the fi-iction brake assemblies, such as hardness, strength, wear resistance, thermal conductivity, and the like.

Also, the friction shoes and pads have been manufactured from asbestos. As the use of asbestos has declined in recent years, the friction shoes and pads are now being manufactured from other materials. The materials used in these newer friction shoes and pads have been found to be more aggressive than those formed from asbestos. Consequently, the drums and rotors which have been formed from "as-cast" gray iron have been found to wear more rapidly. This is particularly a problem when the drums and rotors are used in the brake systems of heavy duty trucks, inasmuch as the load applied to the drums and rotors of such brake systems is very high. Thus, it would be desirable to provide an improved method for manufacturing drums and rotors for friction brake assemblies which retain the benefits of the "as-cast" gray iron method, yet which minimizes premature wear of the drums and rotors.

SUMMARY OF THE INVENTION

This invention relates to an improved method for producing a rotatable brake component from cast gray iron. The brake component is particularly suitable for use in the brake systems of heavy duty trucks. The first step of the present method is providing a cast gray iron rotatable brake component wherein the gray iron has a carbon content between about 3.4% and about 4.0%. The second step is subjecting the cast gray iron rotatable brake component to an austempering heat treatment process which involves heating the cast gray iron rotatable brake component to a temperature between about 1500° F. (816° C.) and about 1700° F. (927° C.) and maintaining this temperature for a time between about one hour and about three hours. The cast gray iron rotatable brake component is then quenched in a liquid bath at a temperature between about 300° F. (149° C.) and about 700° F. (371° C.) for a time between about two hours and about four hours. The third step is subjecting the cast gray iron rotatable brake component to a re-tempering process to provide a microstructure which consists of spheroidized pearlite carbon in a matrix of bainitic and austenitic ferrite (iron). The brake component made by the process has a high tensile strength and excellent wear resistance.

Various objects and advantages of this invention will become apparent to those skilled in the an from the following detailed description of the preferred embodiment, when read in light of the accompanying drawings.

DETAILED DESCRIPTION OF THE PREFERRED EMBODIMENT

Figure 1:
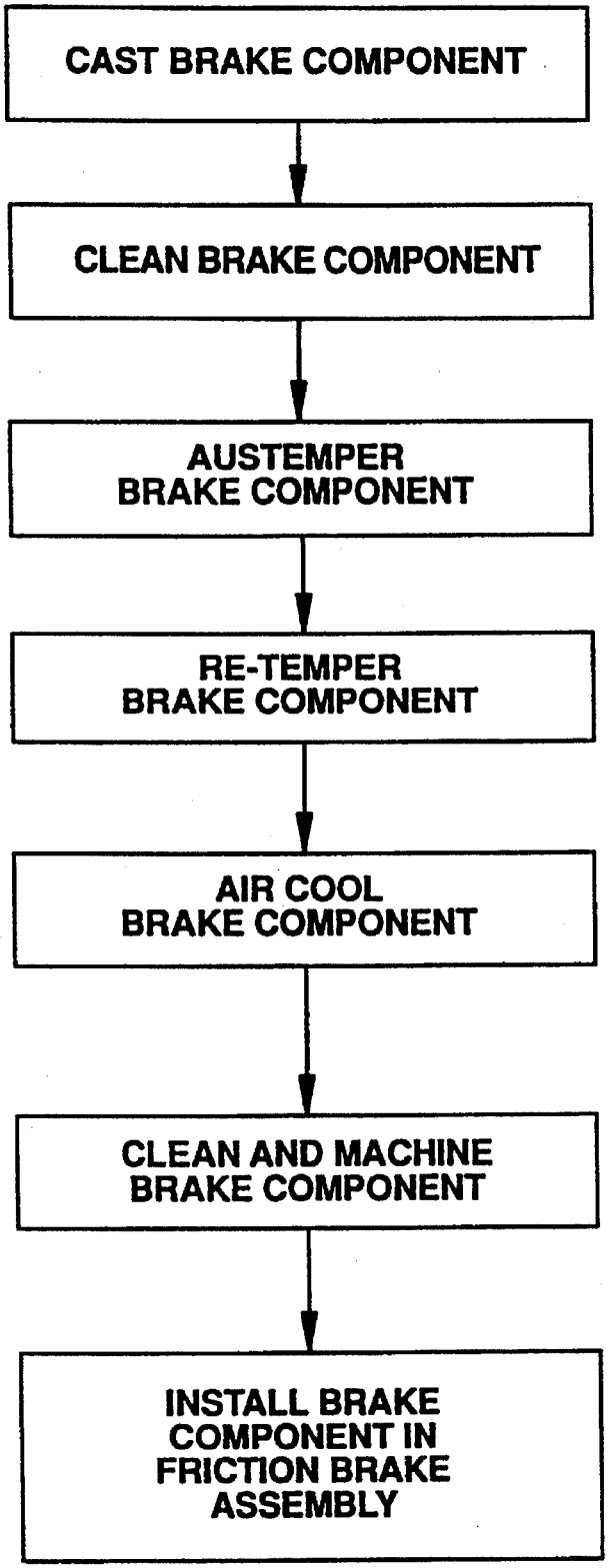
FIG. 1 is a flow chart of the steps involved in the improved method for manufacturing a drum or rotor for use in a friction brake assembly in accordance with this invention.

Referring now to the drawings, there is illustrated in FIG. 1 an improved method for manufacturing a drum or rotor for use in a friction brake assembly in accordance with this invention. Throughout this discussion, the term "brake component" will be used to refer interchangeably to either a drum or rotor adapted for use in a friction brake assembly of the type described above.

Initially, the brake component is cast by pouring molten gray iron into a mold having a desired shape. One preferred brake component shape according to the present invention is an industry standard trailer brake drum. The carbon content of the gray iron used in the casting is higher than that of most gray irons. This higher carbon content is important for providing extended life to the final brake component. The gray iron has a carbon content between about 3.4% and about 4.0%, preferably between about 3.6% and about 3.9%, and most preferably about 3.7%. Preferably the general chemical composition, by weight, of the gray iron used in the present method is about 3.4% to about 4.0% carbon, about 1.0% to about 3.0% silicon, 0% to about 0.5% molybdenum, and the remainder iron. A more preferred gray iron is about 3.70% carbon, about 2.00% silicon. about 0.35% molybdenum, and the remainder iron. This gray iron is available commercially as Grade G3500 gray iron.

Following the initial casting process, the surfaces of the brake component are cleaned. The as-cast brake component has a tensile strength of about 28,000 psi and a Brinell Hardness Number of 179. Tensile strength is measured by a conventional test: ASTM A48-76, Standard Specification for Gray Iron Castings. The standard Brinell hardness test is described in the ASTM method of test E-10.

Having been cast into its desired shape, the brake component is then subjected to an austempering heat treannent process. The austempering heat treatment process is performed in two steps. First, the brake component is heated to a first predetermined temperature and maintained at that temperature for a first predetermined time duration. The temperature and time duration of this initial heating step will vary with the size, shape, and wall thickness of the brake component. Generally, however, the first predetermined temperature is within the range from about 1500° F. (816° C.) to about 1700° F. (927° C.), and the first predetennined time is within the range from about one hour to about three hours. For an industry standard trailer brake drum, a preferred temperature is about 1600° F. (871° C.) and a preferred time is about two hours.

Following this initial heating step in the austempering heat treatment process, the brake component is quenched to a second predetermined temperature and maintained at that temperature for a second predetermined time duration. This quenching step is preferably performed in a liquid bath, such as molten salt. The temperature and time duration of this subsequent quenching process will vary with the size, shape, and wall thickness of the brake component. Generally, however, the second predetermined temperature is within the range from about 300° F. (149° C.) to about 700° F. (371° C.), and the second predetermined time duration is within the range from about two hours to about four hours. For an industry standard trailer brake drum, a preferred temperature is about 500° F. (260° C.) and a preferred time is about three hours.

Following the initial austereporing heat treatment process, the brake component is then subjected to a re-tempering process in which the brake component is again heated to a predetermined temperature and maintained at that temperature for a predetermined time duration. The temperature and time duration of this re-tempering process will vary with the size, shape, and wall thickness of the brake component. Generally, however, the re-tempering temperature is within the range from about 800° F. (427° C.) to about 1400° F. (760° C.), and the re-tempering time is within the range from about one hour to about three hours. For an industry standard trailer brake drum, a preferred temperature is about 1100° F. (593° C.) and a preferred time is about two hours. The re-tempering process is important for providing the desired microstructure in the gray iron. Re-tempering also is important for bringing the metal back to a usable hardness after austempering that allows working of the metal with conventional tooling. The metal is so hard after austempering alone that it cannot easily be worked without special tooling.

After this re-tempering process, the brake component is air cooled to room temperature and cleaned. Depending on the temperatures and time durations of the austempering and re-tempering processes and on the size, shape, and wall thickness of the brake component, the surfaces of the brake component may require a relatively small amount of finish machining after the re-tempering process.

The microstructural properties of the metal of the finished brake component are unique to gray iron brake components. The microstructure consists of spheroidized pearlite carbon in a matrix of bainitic and austenitic ferrite (iron). In essence, this microstructure is a cross between gray iron and ductile iron. The metal has high tensile strength, and high carbon content for a gray iron. The high tensile strength and high carbon content provide extended life to the brake component. Moreover, these improved properties allow brake components to be made using a reduced amount of metal, which results in reduced weight for the brake components. This benefit is particularly important for brake components which are large-sized like those used in heavy duty trucks. The finished brake component has a tensile strength between about 40,000 psi and about 50,000 psi, and is typically about 45,000 psi. It has a Brinell Hardness Number between about 225 and about 285, and is typically about 255.

Figure 2:
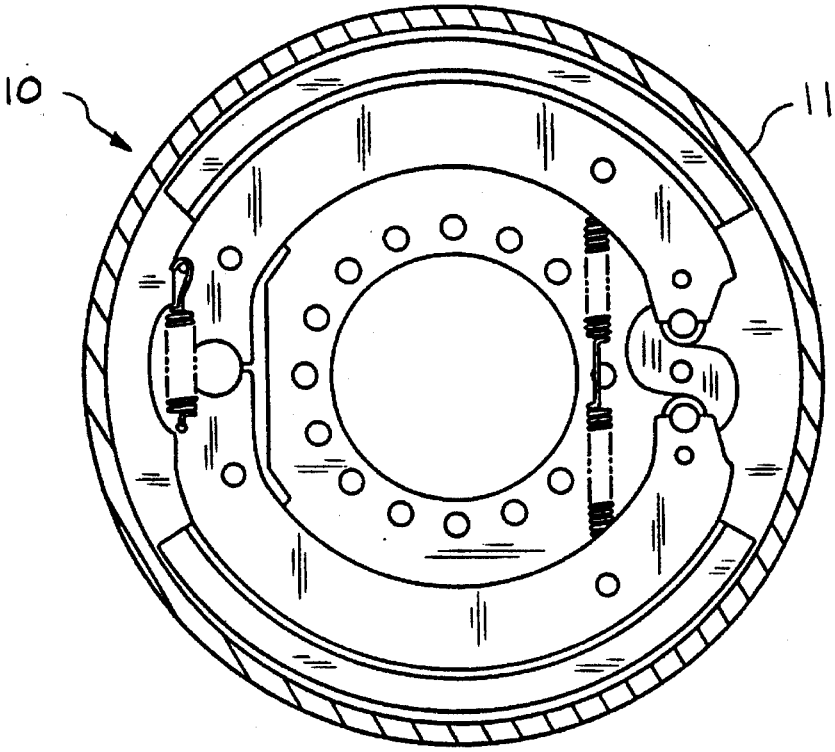
FIG. 2 is a sectional elevational view of a portion of a drum brake assembly including a drum manufactured in accordance with the method illustrated in FIG. 1.

Referring now to FIG. 2, there is illustrated a portion of a drum brake assembly 10 which could be used with a heavy duty truck (e.g., on a trailer) or other vehicle. The drum brake assembly 10 includes a hollow cylindrical drum 11 manufactured in accordance with the method illustrated in FIG. 1. The drum 11 is secured to the wheel (not shown) of the vehicle for rotation therewith, while a brake shoe assembly is secured to a non-rotatable component of the vehicle, such as the vehicle frame (not shown). The illustrated drum brake is an air brake. Thus, the brake shoe assembly includes a pair of arcuate friction shoes 12 and 13 which are operatively connected to a pneumatically actuated piston or "air piston" (not shown). The air piston is attached to a shaft which is attached to an S-cam 14 disposed between ends of the friction shoes 12 and 13. The friction shoes 12 and 13 are disposed within the hollow drum 11 adjacent to the inner cylindrical surface thereof. The friction shoes 12 and 13 are normally spaced apart from the inner cylindrical surface of the drum 11. When the driver of the vehicle manually depresses the brake pedal (not shown), the air piston is actuated to rotate the shaft attached to the S-cam 14. As a result, the S-cam 14 rotates in a counterclockwise direction. Rotation of the S-cam 14 mechanically moves the ends of the friction shoes 12 and 13 apart from one another and forces the friction shoes out into frictional engagement with the inner cylindrical surface of the drum 11. As a result, rotation of the drum 11 and its associated wheel are inhibited.

Figure 3:
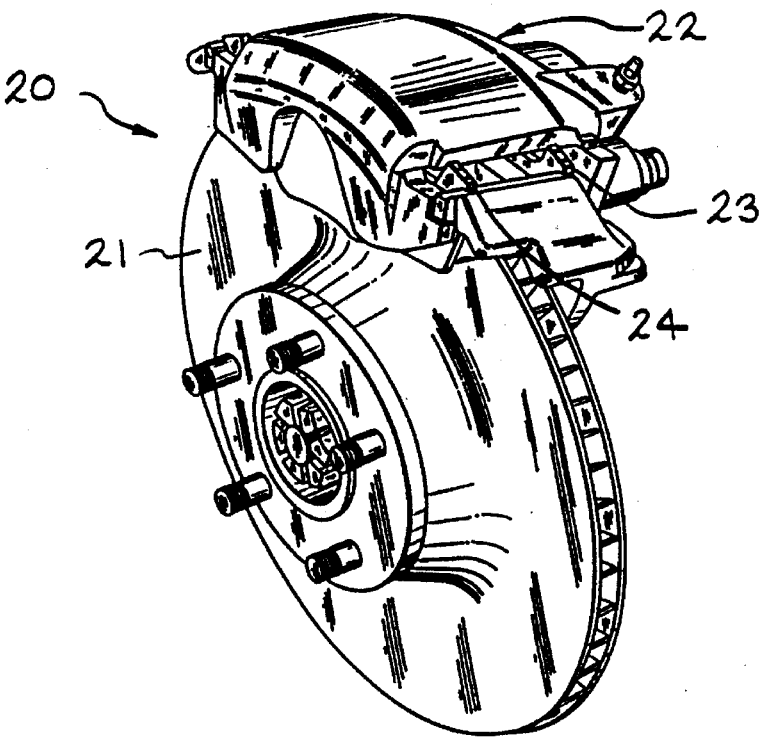
FIG. 3 is a perspective view of a portion of a disc brake assembly including a rotor manufactured in accordance with the method illustrated in FIG. 1.

Referring now to FIG. 3, there is illustrated a portion of a disc brake assembly 20 including a rotor 21 manufactured in accordance with the method illustrated in FIG. 1. The rotor 21 is secured to the wheel (not shown) of the vehicle for rotation therewith, while a brake caliper assembly 22 is secured to a non-rotatable component of the vehicle, such as the vehicle frame (not shown). The brake caliper assembly 22 includes a pair of friction pads 23 and 24 which are operatively connected to a hydraulically actuated piston (not shown). The friction pads 23 and 24 are disposed on opposite axial sides of the rotor 21 and are normally spaced apart therefrom. When the driver of the vehicle manually moves the brake pedal (not shown), the piston is actuated to move the friction pads 23 and 24 toward one another into frictional engagement with the rotor 21. As a result, rotation of the rotor 21 and its associated wheel are inhibited.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A method for producing a brake component comprising the steps of:

(a) providing a cast gray iron rotatable brake component wherein the gray iron has a carbon content between about 3.4% and about 4.0%; then (b) subjecting the cast gray iron rotatable brake component to an austempering heat treatment process which comprises heating the cast gray iron brake component to a temperature between about 1500° F. (816° C.) and about 1700° F. (927° C.) and maintaining this temperature for a time between about one hour and about three hours, and then quenching the cast gray iron rotatable brake component in a liquid bath at a temperature between about 300° F. (149° C.) and about 700° F. (371° C.) for a time between about two hours and about four hours; and then (c) subjecting the cast gray iron rotatable brake component to a re-tempering process to provide a microstructure which consists of spheroidized pearlite in a matrix of bainitc and austenite.

2. The method defined in claim 1 wherein the re-tempering process of step (c) comprises heating the cast gray iron rotatable brake component to a temperature between about 800° F. (427° C.) and about 1400° F. (760° C.) and maintaining this temperature for a time between about one hour and about three hours.

3. The method defined in claim 2 wherein the re-tempering process of step (c) comprises heating the cast gray iron rotatable brake component at a temperature of about 1100° F. (593°C.) for about two hours.

4. The method defined in claim 1 wherein the austempering heat treatment process of step (b) comprises heating the cast gray iron rotatable brake component at a temperature of about 1600° F. (871° C.) for about two hours.

5. The method defined in claim 1 wherein the gray iron has a carbon content between about 3.6% and about 3.9%.

6. The method defined in claim 1 wherein the chemical composition of the gray iron is about 3.4% to about 4.0% carbon, about 1.0% to about 3.0% silicon, 0% to about 0.5% molybdenum, and the remainder iron.

7. The method defined in claim 1 wherein the finished brake component has a tensile strength between about 40,000 psi and about 50,000 psi.

8. The method defined in claim 1 wherein the finished brake component has a Brinell Hardness Number between about 225 and about 285.

9. A method for producing a brake component comprising the steps of:

providing a cast gray iron rotatable brake component, subjecting the brake component to an austempering heat treatment process, and subjecting the austempered brake component to a re-tempering process.

10. The method defined in Claim 9 wherein the re-tempering process comprises heating the brake component to a temperature between about 800° F. (427° C.) and about 1400°F. (760° C.) and maintaining this temperature for a time between about one hour and about three hours.

11. The method defined in claim 10 wherein the re-tempering process comprises heating the brake component at a temperature of about 1100° F. (593° C.) for about two hours.

12. The method defined in claim 9 wherein the austempering heat treatment process comprises heating the brake component to a temperature between about 1500° F. (816° C.) and about 1700° F. (927° C.) and maintaining this temperature for a time between about one hour and about three hours.

13. The method defined in claim 12 wherein the austempering heat treatment process additionally comprises quenching the brake component in a liquid bath at a temperature between about 300° F. (149° C.) and about 700° F. (371° C.) for a time between about two hours and about four hours.

14. The method defined in claim 9 wherein the finished brake component has a tensile strength between about 40,000 psi and about 50,000 psi.

15. The method defined in claim 9 wherein the finished brake component has a Brinell Hardness Number between about 225 and about 285.

16. The method defined in claim 9 wherein the gray iron has a carbon content between about 3.4% and about 4.0%.

17. The method defined in claim 9 wherein the finished brake component has a microstincture which consists of spheroidized pearlite in a matrix of bainite and austenite.

18. A method for producing a brake component comprising the steps of:

providing a cast gray iron rotatable brake component, subjecting the brake component to an austempering heat treatment process which comprises heating the brake component to a temperature between about 1500° F. (816° C.) and about 1700° F. (927° C.) and maintaining this temperature for a time between about one hour and about three hours, and subjecting the austempered brake component to a re-tempering process which comprises heating the brake component to a temperature between about 800° F. (427° C.) and about 1400° F. (760° C.) and maintaining this temperature for a time between about one hour and about three hours.

19. The method defined in claim 18 wherein the austempering heat treatment process additionally comprises quenching the brake component in a liquid bath at a temperature between about 300° F. (149° C.) and about 700° F. (371° C.) for a time between about two hours and about four hours.

20. The method defined in claim 18 wherein the finished brake component has a microstincture which consists of spheroidized pearlite in a matrix of bainite and austenite.

* * * * *